US005772067A

United States Patent [19]

Morewitz, II

[11] Patent Number: 5,772,067

[45] Date of Patent: Jun. 30, 1998

[54] CAP SYSTEM WITH BUOYANT SLIDING COVER AND SPRING MECHANISM

[76] Inventor: Herbert Morewitz, II, 7 Conway Rd., Newport News, Va. 23606

[21] Appl. No.: 655,899

[22] Filed: May 31, 1996

[51] Int. Cl.[6] ..... A47G 19/22

[52] U.S. Cl. ..... 220/714; 220/203.2; 220/254; 220/348; 215/315

[58] Field of Search ..... 220/714, 202, 220/203.2, 254, 346, 348; 215/315

[56] References Cited

U.S. PATENT DOCUMENTS

| | | | |
|---|---|---|---|
| 2,433,142 | 12/1947 | Moen | 220/348 |
| 3,938,690 | 2/1976 | Butler | 220/714 |
| 4,057,167 | 11/1977 | Lee | 220/348 X |
| 5,199,597 | 4/1993 | Gladfish | 220/715 |
| 5,542,575 | 8/1996 | Stark et al. | 220/256 |

FOREIGN PATENT DOCUMENTS

| | | | |
|---|---|---|---|
| 29331 | 3/1993 | Netherlands | 220/714 |
| 56349 | 8/1931 | United Kingdom | 220/714 |

*Primary Examiner*—Stephen Cronin

[57] ABSTRACT

A cap system for use with a beverage container that has automatic opening and closing capability is provided. A buoyant sliding cover is maintained partially within a casing or housing device in the cap and partially within the container itself. When the container is tilted to a drinking position, buoyancy forces act on the cover and force it to slide, thereby exposing an opening in the cap and allowing for the consumption of the liquid. When the container is returned to an upright, non-drinking position, a spring mechanism, built into the casing and attached to the sliding cover, acts to force the cover to a closed position, thereby covering the opening in the cap and preserving the integrity of the liquid inside.

6 Claims, 2 Drawing Sheets

CAP SYSTEM WITH BUOYANT SLIDING COVER AND SPRING MECHANISM

FIELD OF THE INVENTION

This invention relates generally to beverage container caps or lids and more particularly to a cap system that is designed to and capable of, automatically and without user activation, opening via buoyancy forces exerted upon a sliding cover and closing via a spring mechanism, thereby maintaining the integrity of a liquid beverage inside the container by keeping undesirable objects out of the container and hence, out of the liquid beverage.

BACKGROUND OF THE INVENTION

It has become commonplace for people to consume beverages from personal beverage containers or the like. It is not uncommon, in this day and age, to encounter a wide range of insects and debris in the air. In as much as no one desires to find an insect or foreign object in one's beverage, there exists an immediate need for a beverage container cap system that acts, on its own and automatically, to open and close,thereby preventing undesirable objects from entering one's beverage container.

DESCRIPTION OF THE PRIOR ART

Though there is prior art in this general field, most notably Gorka et al, patent number U.S. Pat. No. 5,186,196 and McCabe, U.S. Pat. No. 5,310,081, a problem with these and other like kind devices is that they either require some sort of user activation and/or manipulation or they do not adequately preserve the integrity of the liquid within the container.

SUMMARY OF THE INVENTION

Accordingly, it is the object of the present invention to provide a beverage container cap system, which can be a press-fit or snap-on type cap, that is capable of opening and closing automatically and without user activation or manipulation. The automatic opening function is accomplished by way of a buoyant sliding cover, hereafter referred to as "tab". The tab is partially maintained within a casing built into the cap, and partially maintained in the container itself when the cap is attached or affixed to said container.

As the container is tilted to a drinking position, the beverage naturally flows towards the opening in the cap. The tab becomes immersed in the liquid. The upward pressure exerted upon the tab by the liquid causes the tab to slide or "rise" within the casing, thereby exposing the opening in the cap and allowing for the flow of the beverage through the cap opening and for the consumption of the beverage. When the container is returned to an upright, non-drinking position, a spring mechanism, built into the casing and which is attached to the tab itself, forces the tab to a "closed" position, effectively covering the opening in the cap. It should be noted that this device shall be designed and manufactured in such a way as to insure that, in operation e.g. drinking position, the buoyancy force on the tab shall defeat the force of the spring mechanism.

DETAILED DESCRIPTION OF THE INVENTION

Figure 1:
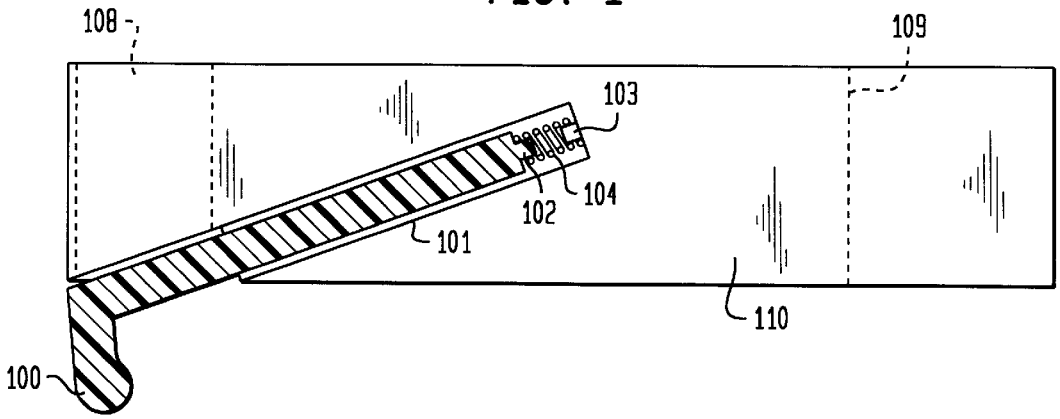
FIG. 1 is a side elevation, in partial section; showing the device within the cap system in a closed position.
Figure 2:
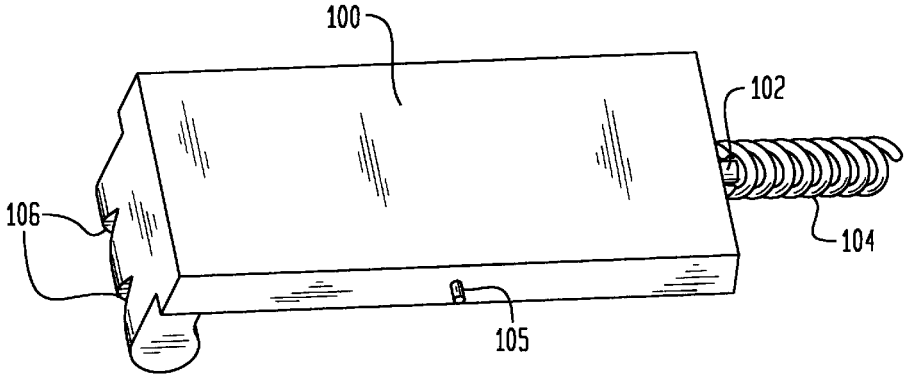
FIG. 2 is a perspective view of the sliding tab.
Figure 5:
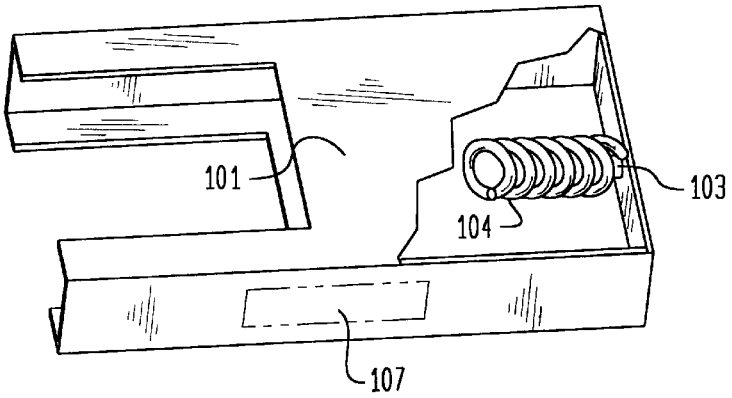
FIG. 5 is a perspective view partly in section showing the tab casing that contains the sliding tab.

Referring now to the drawings and, more particularly to FIG. 1, the cap system(110) providing automatic opening and closing capability. The cap(110) includes, generally, an opening(108) in the cap(110), a sliding tab(100), a tab casing(101), a spring mechanism(104) and a small air hole (109). The overall cap system(110) is preferably circular in design with press-fit or snap-on capability, with such components and features having been omitted from the drawings as these aspects are well understood in the art and need not be described herein. The sliding tab(100), as shown in FIG. 2, is a buoyant tab and is constructed within the cap(110) such that it is at a declining angle to maximize the buoyancy forces on the tab(100) and slides within the tab casing(101), which is also built at the same declining angle as the tab(100), to effect the opening and closing functions described. The rear end of the tab(100),opposite the end that operates at the cap opening(108), is terminated in a small protruding circular spring guide(102), which attaches to the spring(104) and serves to keep the spring(104) in line and in place with the tab casing spring guide(103), as shown in FIG. 5. For purposes of description, the spring(104) shall slide over the spring guides(102) and (103) for a sleeve type fit. Affixed to the side of the tab(100) is a stop(105) which inserts and operates within the stop guide(107) of the casing(101). In operation, the stop(105) slides back and forth within the stop guide(107) in sync with the movement of the tab(100). The stop(105) serves to keep the tab(100) from ejecting from the casing(101). It should be noted that the stop105) and stop guide(107), though described herein, may be deleted during manufacturing if deemed to be non-essential.

Figure 3:
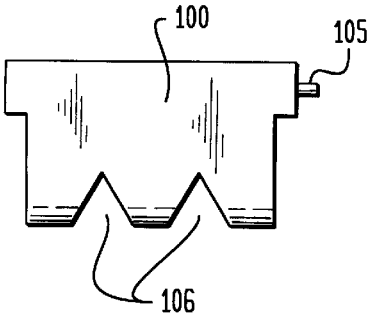
FIG. 3 is a front view of the sliding tab showing the "V" grooves and stop.
Figure 4:
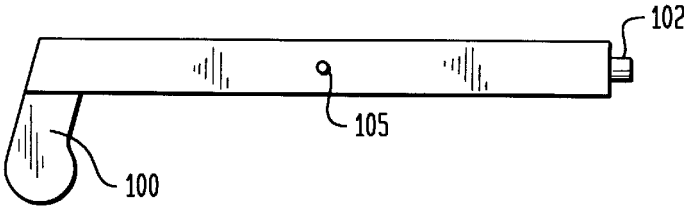
FIG. 4 is a side view of the sliding tab showing the stop and spring guide.

The operative end of the tab(100) is terminated in a cylindrical form, which is still an integral part of the tab(100). In the cylinder are "V" type grooves(106), as shown in FIG. 3. These grooves(106) serve two purposes, both while the device is in operation. One, to allow the liquid to make its way under the tab(100) and, two, to allow any liquid which may end up on top of the cylinder to flow "through" the cylinder, so as not to create a downward force on the cylinder or tab(100) while in operation, which is contrary to the intent of the device. Finally, the front end of the tab(100) which operates at the the cap opening(108) and is opposite the tab spring guide(102) is designed to have a curved or circular form so as to coincide with the curved or circular form of the cap system(110) and container to allow for the most efficient sealing process.

The tab casing(101), as shown in FIG. 5, is embedded in the cap system(110) at a declining angle, the same as the tab(100), to maximize the buoyancy force upon the tab(100). This casing(101) serves to contain the tab(100) and is designed to be slightly larger, wider, etc. than the tab(100) to allow for a smooth sliding process of the tab(100) within the casing(101) and at the cap opening(108). Obviously, the design of the casing(101) nearest the cap opening(108) is such that it is open and unobtrusive at this end, to allow for the sliding process. The inside rear end of the casing(101) contains a small protruding circular spring guide(103) which attaches to a spring(104) with other end of said spring(104)

attaching to the tab spring guide(102), which effects the automatic closing function of the device. For purposes of description, the spring(104) shall slide over the spring guides(103) and (102) for a sleeve type fit.

Figure 6:
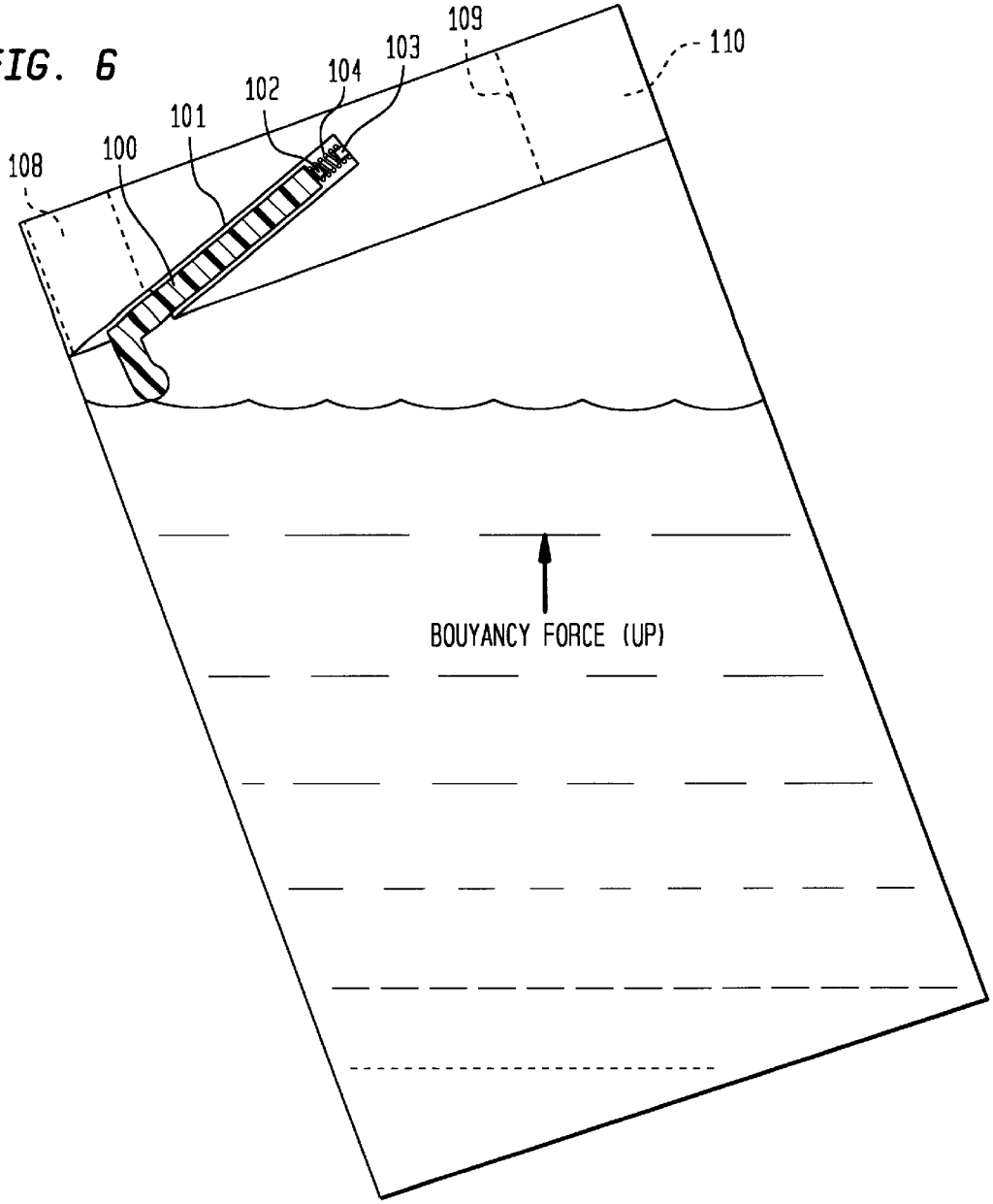
FIG. 6 is a section view showing the device in operation.

FIG. 6 shows the device in operation, with the buoyancy forces of the liquid exerting an upward force on the tab(100) causing the tab(100) to slide or open, thereby exposing the opening(108) in the cap system(110) and allowing for the consumption of the liquid beverage inside the container It should be noted that in order to make this device as inexpensive to manufacture as possible, plastics or other synthetics should be used as much as possible. Furthermore, the sliding tab can be made up of either a solid buoyant material or can be an evacuated airtight, airfilled device, or can be a combination of both.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than specifically described.

What is claimed as new and desired to be secured by Letters Patent of the United States is:

1. A cap system for a container of liquid, comprising:

a cap mountable at the top of said container, said cap defining a dispensing opening therethrough and a downwardly angled sleeve therein that opens into said container in proximity to said dispensing opening; and a tab of buoyant construction mounted in said sleeve for sliding engagement therewith, said tab having a first end residing in said sleeve and a second end residing out of said sleeve, wherein said tab slides down said sleeve to close off said dispensing opening when said container is in an upright position and wherein, when said container is tipped such that said liquid is in contact with said second end of said tab, said tab slides up said sleeve away from said dispensing opening.

2. A cap system as in claim 1, further comprising a spring mechanism mounted between said first end of said tab and said sleeve wherein said spring mechanism is biased to slide said tab down in said sleeve until said second end contacts an inside wall of said container when said container is in the upright position.

3. A cap system as in claim 1 wherein said second end of said tab is cylindrical in form.

4. A cap system as in claim 1 wherein said cap is further provided with an air hole passing therethrough and positioned such that when said container is tipped, air can enter said container through said air hole.

5. A cap system as in claim 1 wherein said second end is shaped to substantially conform to an inner wall of said container against which said second end comes to rest when said container is in the upright position.

6. A cap system as in claim 5 wherein said second end incorporates at least one vertical groove formed therein.

* * * * *